United States Patent [19]

Stottmann et al.

[11] 4,282,720

[45] Aug. 11, 1981

[54] REFRIGERATOR AIR BAFFLE CONTROL

[75] Inventors: Richard L. Stottmann; Gerhard K. Losert, both of Louisville, Ky.

[73] Assignee: General Electric Co., Louisville, Ky.

[21] Appl. No.: 70,565

[22] Filed: Aug. 29, 1979

[51] Int. Cl.[3] ..... F25D 17/00; F16K 31/44

[52] U.S. Cl. ..... 62/180; 62/187; 251/230; 74/129

[58] Field of Search ..... 62/187, 408, 180; 251/230, 138; 74/129

[56] References Cited

U.S. PATENT DOCUMENTS

| | | | |
|---|---|---|---|
| 2,627,755 | 2/1953 | Hooker | 74/129 |
| 3,136,335 | 6/1964 | Beech et al. | 251/230 X |
| 3,793,847 | 2/1974 | Scarlett et al. | 62/187 |
| 3,868,861 | 3/1975 | Scholin | 74/129 |
| 4,059,966 | 11/1977 | True, Jr. | 62/414 |

*Primary Examiner*—William E. Wayner

*Attorney, Agent, or Firm*—Frank P. Giacalone; Radford M. Reams

[57] ABSTRACT

A side-by-side refrigerator of the type having a single evaporator, single fan including a freezer compartment thermostat controlling operation of the evaporator and fan, and a fresh food compartment thermostat controlling the operation of the fan and an air flow control for circulating the colder freezer compartment air through the fresh food compartment. The air flow control includes an air valve mounted in a passageway that is movable between a closed set position and an open set position. When cooling of the fresh food compartment is required, the fan is energized and the valve rotated to its open position. When the cooling requirements are satisfied, the thermostat causes the fan to deenergize and the valve to be rotated to its closed position. However, the fan may continue to operate under control of the freezer compartment thermostat. The valve moves between its open and closed positions of 90° by a solenoid that is momentarily energized. The energization of the solenoid effectively moves the valve 45° in each direction of its armature reciprocal movement.

18 Claims, 6 Drawing Figures

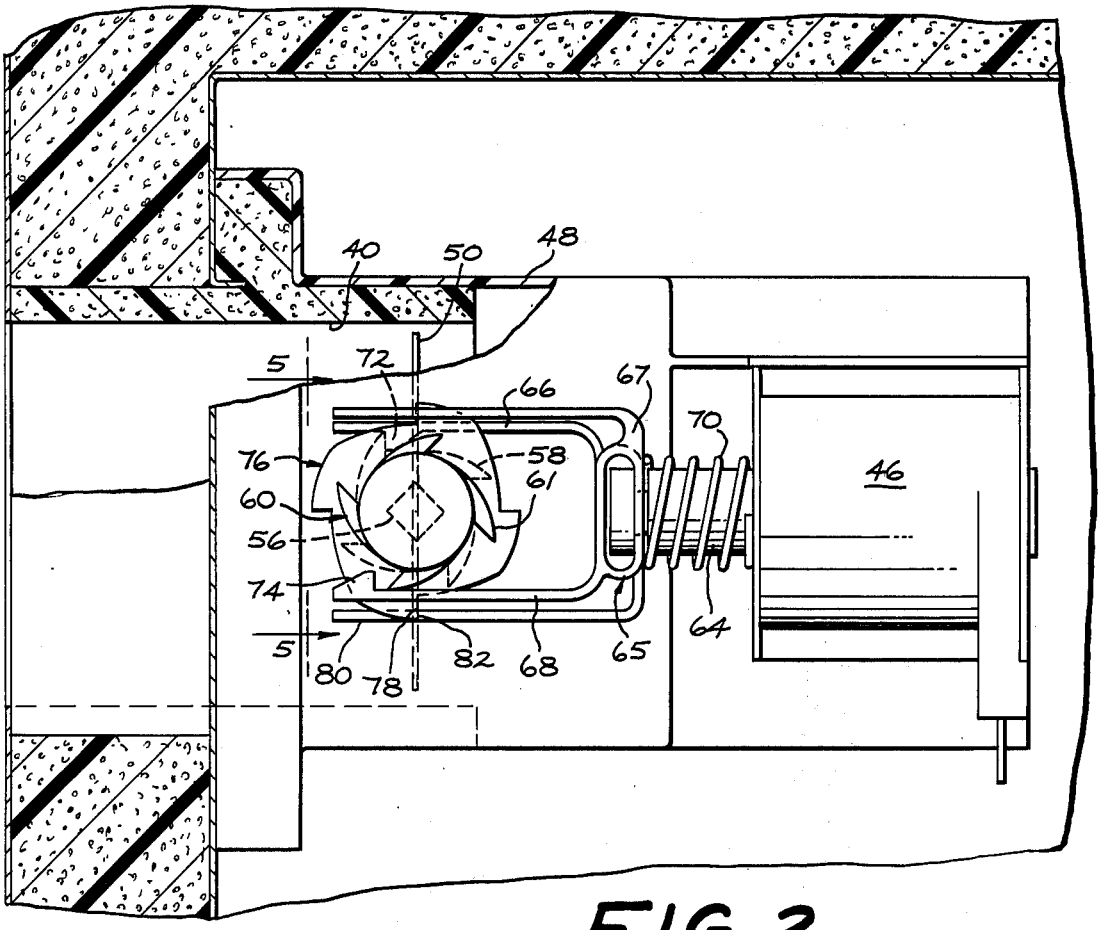
FIG. 2
FIG. 3
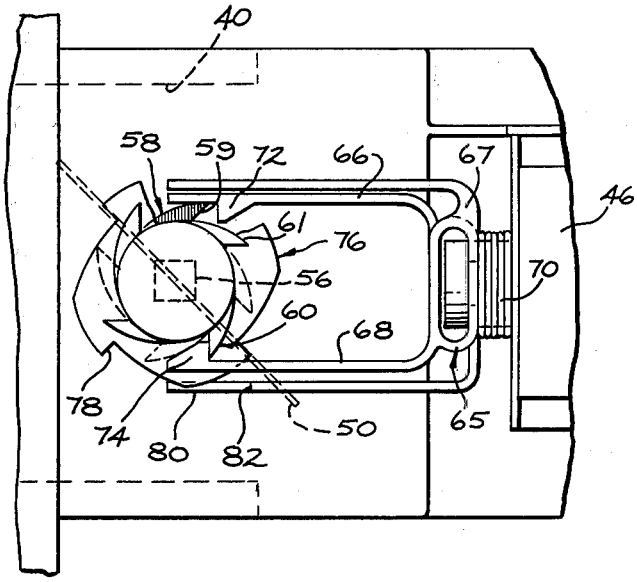

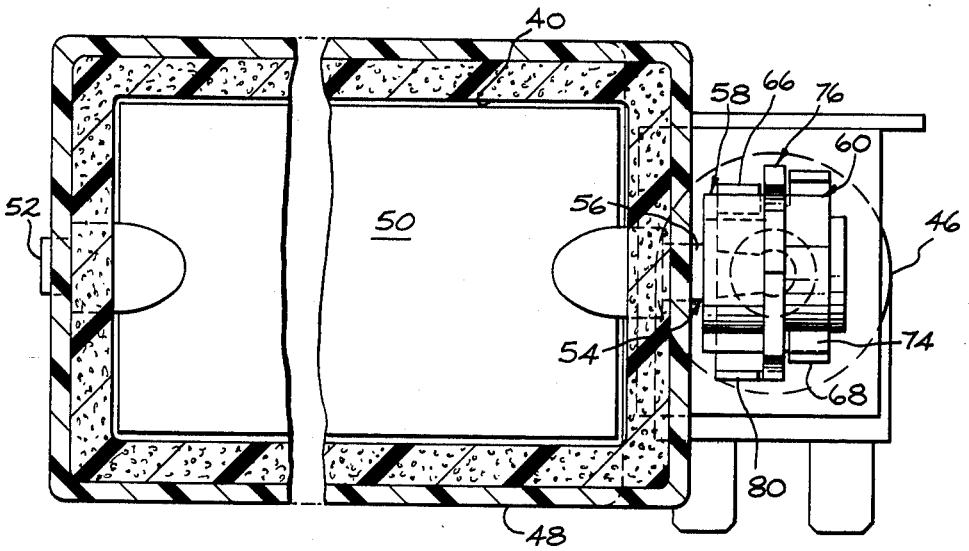
FIG. 5
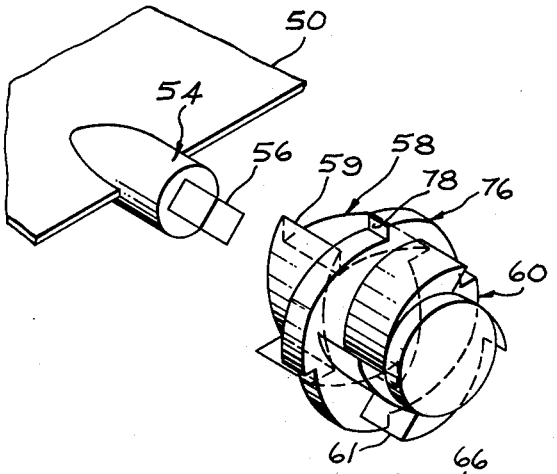
FIG. 6
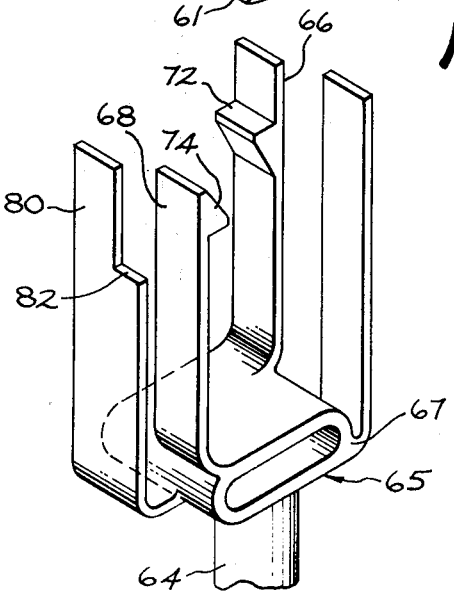

REFRIGERATOR AIR BAFFLE CONTROL

BACKGROUND OF THE INVENTION

This invention relates generally to refrigerators and more particularly to an improved temperature control system and air flow distribution arrangement for a multi-compartment refrigerator, including independent freezer compartment and fresh food compartment temperature controls.

Generally, in a dual compartment refrigerator of the forced air circulation type, a single fan and a single evaporator are provided usually in the freezer compartment. In this type refrigerator, as disclosed in U.S. Pat. Nos. 3,126,717-Schumacher and 3,320,761-Gelbard, assigned to General Electric Company, assignee of the present invention, thermostatic control of the evaporator is achieved, using an air temperature sensing element located in the warmer fresh food storage compartment. To provide desired temperature differential between the fresh food storage compartments, an adjustable air flow divider is employed to proportion the flow of air cooled by the evaporator through the frozen and food storage compartments.

The temperature in the fresh food compartment is thermostatically controlled by energizing the compressor and fan in response to the cooling requirements of the fresh food compartment. Being under actual thermostatic control, the temperature is maintained quite efficiently at approximately the desired temperature. The temperature in the freezer compartment is not thermostatically controlled but rather is controlled by varying the flow of refrigerated air from the evaporator to the fresh food compartment, thereby forcing the compressor to run for either longer or shorter periods of time to satisfy the requirements of the fresh food compartment, indirectly affecting the temperature in the freezer compartment.

The present invention overcomes the problem of temperature control by providing independent temperature sensing controls in each of the compartments wherein the freezer temperature control energizes the compressor and fan, while the fresh food control energizes the fan only and causes air flow into the fresh food compartment from the freezer compartment.

SUMMARY OF THE INVENTION

By the present invention there is provided a refrigerator cabinet comprising a divider wall separating said cabinet into a freezer and fresh food compartment. Arranged within the cabinet is a refrigerator system including a condenser evaporator and compressor in closed series flow arrangement. The evaporator being arranged in the freezer compartment.

An air circulating system, including a fan, is arranged in the freezer compartment for circulating air from both of the compartments through the evaporator. Located on the divider is a housing that includes a passageway for directing a portion of the circulating air into the fresh food compartment. A first temperature control means located in the freezer compartment causes energization of the compressor and fan so that the freezer compartment is maintained at a preselected temperature.

Means are provided for controlling the flow of air between compartments, including a valve in the passageway having axial members arranged in the housings for allowing rotational movement of the valve between set open and closed positions. The valve is maintained in either its open or closed position by an indexing means arranged on one of said axial members that has a drive end extending through the housing. The indexing means include a first and second ratchet mounted on the drive end. Each ratchet has a like number of teeth that are spaced circumferentially so that the teeth of one of the ratchets are positioned intermediate the other.

The ratchets are rotated by a solenoid mounted on the housing. The solenoid is energized momentarily and includes an armature arranged for perpendicular movement relating to the axial members between a normal retracted position and a momentary extended position. Mounted on the armature are actuating means including a first pawl dimensioned to engage a tooth on the the first ratchet for imparting initial rotational movement to the valve during movement of the armature in one direction and a second pawl dimensioned to engage a tooth on the second ratchet for imparting a secondary continuing rotational movement to the valve during the return movement of the armature in the other direction to thereby complete movement of the valve between its set positions.

Means are provided for locking the valve in each of its set positions when the armature is in its deenergized position. To this end, a stop means having spaced teeth is positioned on the drive end. Holding means movable with the armature is dimensioned to engage one of the teeth on the stop means when the solenoid is in its deenergized, extended position so that the valve stops in its set position, either fully open or closed. A second temperature control means in the fresh food compartment is arranged for energizing the solenoid and fan to control the flow of air through the passageway when the valve is in its fully open position.

BRIEF DESCRIPTION OF THE DRAWINGS

FIG. 2 is a plan view of the air flow control taken along Lines 2—2 of FIG. 1;

FIG. 3 is a partial plan view of FIG. 2 showing the actuating mechanism in another position;

FIG. 5 is a side view taken along Lines 5—5 of FIG. 2; and

FIG. 6 is an exploded perspective view showing the various parts of the actuating mechanism.

DESCRIPTION OF THE PREFERRED EMBODIMENT

Figure 1:
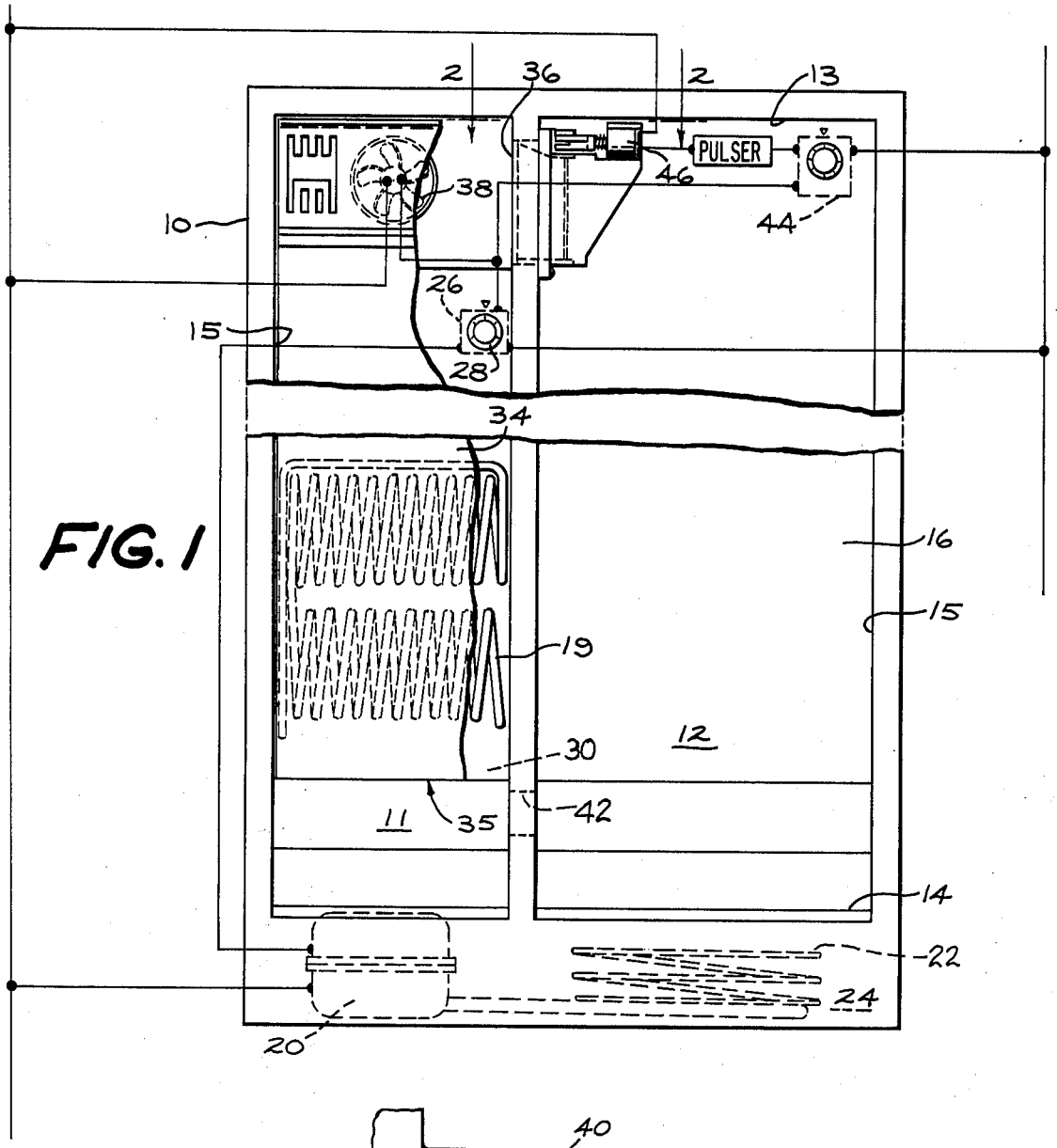
FIG. 1 is a front elevational view of a side-by-side refrigerator embodying the invention, the front door being removed for convenience of illustration.

With reference to FIG. 1, the refrigerator cabinet 10 includes a pair of compartments 11 and 12 disposed in side-by-side relation and defined by insulated top, bottom, side and rear walls 13, 14, 15 and 16, respectively, in cooperation with an insulated central or dividing wall 17 integrally formed with walls 13, 14 and 16. The construction of this refrigerator may be, and preferably is, of the type disclosed in U.S. Pat. No. 4,059,966-True,Jr., assigned to the assignee of this invention.

Cooling is afforded by an evaporator 19 connected in conventional series refrigerant flow circuit with a compressor 20, a condenser 22 and a restrictor (not shown). The compressor 20 and condenser 22 are arranged in a compartment 24 provided in the lower region of cabinet 10.

In the present embodiment, operation of the compressor 20 to establish desired temperature is under the control of an adjustable thermostat 26 provided with a knob 28 and having its sensing element (not shown) in the freezer compartment 11 so that it is responsive to temperature of air therein.

The evaporator 19 is disposed in the freezer compartment 11 and more specifically within an evaporator air channel or duct 30 defined by the inner portion of wall 16 and an evaporator air channel cover 34. The evaporator air channel 30 extends generally parallel to and spaced from the inner portion of wall 16 in the freezer 11 and has an air inlet 35 near the lower portion of compartment 11 and an air outlet, generally designated at 36, near the top thereof. In order to cool the compartments 11 and 12, an air moving means in the form of a fan 38 is included in the freezer compartment 11 for forcing circulation of air over the evaporator 19 and through the air channel 30.

The present air flow distribution, under influence of fan 38, apportions the cool evaporator air passing through the air outlet between a major and minor air stream. The major air stream flows generally downwardly through the freezer compartment 11 to reenter the evaporator air channel 30 through the inlet 35. The minor air stream passes through a passageway 40 in the partition 17 into the top of the fresh food compartment 12. This minor air stream passes generally downwardly through the fresh food compartment 12 and back through a second passageway 42 into the lower portion of partition 17 to reenter the lower portion of the evaporator air channel 30 through inlet 35.

In the present embodiment, the temperature of the freezer compartment is, as mentioned above, established by the thermostat 26. The thermostat 26 controls circuits (not shown) to both the fan 38 and compressor 20. Accordingly, when cooling of the freezer compartment 11 is required, both the compressor 20 and fan 38 are energized and cycled as necessary to maintain the freezer compartment at the selected temperature under control of the freezer thermostat 26. The temperature of the fresh food compartment 12 is under control of adjustable thermostat 44 located in the fresh food compartment. The thermostat 44 controls circuits (not shown) to both the fan 38 and a minor air flow control solenoid 46 whose operation will be explained fully below. Accordingly, when cooling of the fresh food compartment 12 is required to maintain it at a selected temperature, both the fan 38 and solenoid 46 are energized under control of the fresh food thermostat 44. Operation of the fan 38 in response to the cooling requirements of the fresh food compartment and energization of solenoid 46 cause the minor air stream to circulate through fresh food compartment 12 in the following manner.

By the present invention, means are provided in the passageway 40 to insure that there will be an exchange of air between the compartments only when the thermostat 44 calls for cooling and the fan 38 energized, as explained above.

Referring now to FIGS. 2–6, the means in the present embodiment to control air flow between the compartments includes a housing 48 in which the passageway 40 is formed, and an air valve 50 which, as will be explained in detail, is movable between a substantially closed set position and a substantially open set position.

It should be noted that the valve 50 is dimensioned so that in its closed position it will close off passageway 40 to effectively prevent air flow between the compartments. The air valve 50 includes a pair of axial members 52 and 54 that are pivotally arranged in opposing walls of the housing 48 to allow rotational movement of the valve in passageway 40. The axial member 54 extends through the housing wall and includes a drive end 56. Mounted on the drive end 56 of axial member 54 are a pair of ratchet wheels 58 and 60. The ratchet wheels 58 and 60 are peripherially formed with equally spaced ratchet teeth 59 and 61 respectively. The end 56, as shown in FIG. 6, is rectangular so as to allow positioning of teeth of ratchet wheels 58 and 60 relative to the valve 50. The teeth 59 and 61 are arranged on their respective ratchet wheels 58 and 60 so that the teeth of one ratchet wheel are positioned circumferentially intermediate the teeth of the other ratchet wheel. In the present embodiment four teeth 59 and 61 are arranged on each of the wheels 58 and 60 respectively. The teeth on each wheel are spaced equally at 90° with the resulting intermediate arrangement effectively placing alternate teeth of each wheel at 45°. Positioned on opposite sides of, and cooperating with the wheels 58 and 60 are a pair of resilient pawl carrier arms 66 and 68 respectively. The arms 66 and 68 are the spaced-apart side portions of a generally U-shaped ratchet actuating member 65, including a base portion 67. The actuating member 65 is secured to and thereby effectively mounted for reciprocal movement with the armature 64 of solenoid 46. Formed on the arm 66 is an inwardly projecting pawl 72 which is arranged to engage the teeth 59 on ratchet wheel 58, while an inwardly projecting pawl 74 on arm 68 is arranged to engage the teeth 61 on ratchet wheel 60. the armature 64 moves within the solenoid between a biased normal extended position and its energized retracted position in the usual manner. Arranged on the armature 64, is a return spring 70 that effectively restores and maintains the armature in its normally extended position after it has been retracted upon energization of the solenoid.

Figure 4:
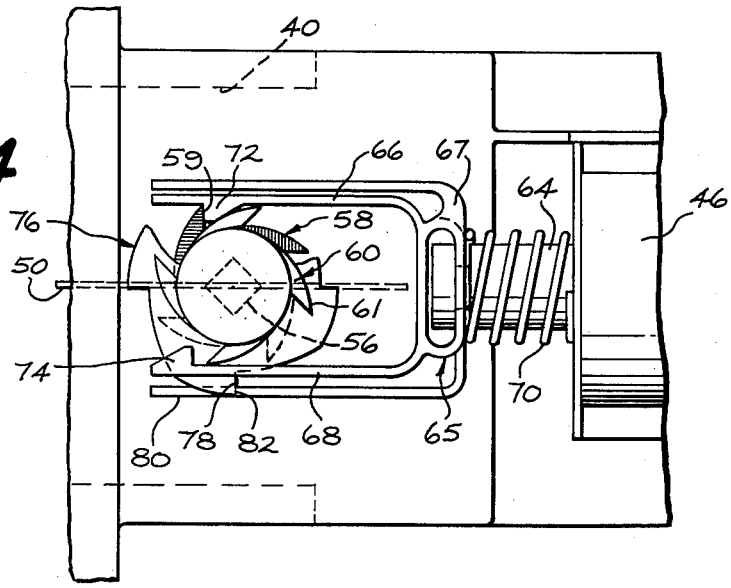
FIG. 4 is a view similar to FIG. 3 showing the mechanism in still another position.

The valve 50 in the present embodiment will always be in either its fully closed set position shown in FIG. 2 when the temperature in the fresh food compartment is at its selected temperature or in its fully open position as shown in FIG. 4 when the thermostat 44 calls for cooling of the fresh food compartment. In operation, when the thermostat 44 calls for cooling of the fresh food compartment 12, the solenoid is energized to position valve 50 in its open set position and fan 38 is energized to initiate the minor air flow through passageway 40 and compartment 12, as stated hereinabove. However, while energization of the solenoid is momentary, the fan will continue to operate until the temperature of the fresh food compartment is lowered to the selected temperature. When the temperature of compartment 12 reaches the selected temperature, the fan is deenergized and the solenoid once again is momentarily energized to cause the valve 50 to move to its fully closed position. It should be noted that the fan may continue to operate at this time under control of the freezer thermostat 26 if further cooling of the freezer compartment is required. Regardless of which of its set positions valve 50 is in, momentary energization of solenoid 46 and the retraction of armature 64 causes pawl 74 of arm 68 to engage one of the teeth 61 of ratchet wheel 60. This movement of the armature and more particularly member 65, causes the pawl 74 through its engagement of a tooth 61 to impart a 45° rotational movement to the valve 50 to an intermediate position as shown in FIG. 3. As mentioned above, the retraction of armature 64 is against action of the restoring spring 70.

Accordingly, the immediate deenergization of solenoid 46 causes pawl 72 of arm 66, under influence of spring 70, to engage one of the teeth 59 of ratchet wheel 58. This restoring movement of the armature causes the pawl 72 through its engagement of a tooth 59 to impart a continuing 45° rotational movement to the valve 50 to place the valve 50 in its fully open set position as shown in FIG. 4.

In summary, momentary energization of the solenoid 46 will cause 90° rotation of the valve 50 either from its fully closed position of FIG. 2, wherein exchange of air between compartments 11 and 12 is prevented, to its fully open position of FIG. 4 to provide air flow and cooling of compartment 12, or in reverse from its open air flow position to its closed position to terminate air flow.

Means are also provided for insuring the positioning of valve 50 in either of its set positions. To this end, a stop wheel 76 formed with teeth 78 spaced 90° apart is mounted for rotation with axial member 54. An index member or carrier arm 80 extends from member 65 and is arranged substantially parallel to the arm 68. Arm 80 includes a stop portion 82 which is dimensioned to contact a tooth 78 of wheel 76 in the following manner.

From its retracted position arm 80 and more particularly stop 82 in moving to its normal extended position will position itself under and engage one of the teeth 78 of wheel 76. This engagement of stop 82 with a tooth 78 prevents further counterclockwise rotation of the valve 50 beyond the valve set position. Clockwise rotation is prevented by the relationship of pawl 72 under a tooth 59 of wheel 58 in the extended position of the armature.

It should be noted that means not shown since it does not form a part of this invention and not crucial to the operation of the present system may be provided that would insure that the valve 50 was in its proper position relative to the function of the thermostat 44. In effect, energization of solenoid 46 in response to a cooling requirement requires that valve 50 move from its closed to open position, and the energization of fan 38 takes place under control of thermostat 44 when valve 50 is in its open position. Energization of solenoid 46 in response to thermostat 44 sensing the fresh food compartment at its selected temperature requires that valve 50 move from its open to closed position, and that fan 38 be deenergized.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A refrigerator cabinet including a divider wall separating said cabinet into a freezer and fresh food compartments;

a housing arranged on said divider including a passageway communicating with said compartments;

a valve member arranged in said housing for controlling the flow of air between compartments, said valve including axial members on the longitudinal ends thereof being arranged in said housing for allowing rotational movement of said valve in said passageway between set open and closed positions, one of said axial members having a drive end extending through said housing;

valve positioning means on said drive end including a first and second ratchet means, each having a like number of teeth being spaced circumferentially so that the teeth of one of said ratchets are positioned intermediate the other;

a solenoid mounted on said housing including an armature arranged for perpendicular movement relative to said axial members between a normal retracted position and a momentary extended position;

actuating means on said armature including a first pawl dimensioned to engage a tooth on said first ratchet for imparting initial rotational movement to said valve during movement of said armature in one direction and a second pawl dimensioned to engage a tooth on said second ratchet for imparting a secondary continuing rotational movement to said valve during the return movement of said armature in the other direction to complete movement of said valve between its set positions;

means for locking said valve in either of its set positions when said armature is in its deenergized position, including stop means on said drive end having spaced teeth, holding means movable with said armature being dimensioned to engage one of said teeth on said stop means when said solenoid is in its deenergized position to hold said valve in its set positions.

2. The invention set forth in claim 1 wherein said solenoid is energized momentarily.

3. The invention set forth in claim 2 wherein said armature is maintained in its extended position by a spring means so that initial movement of said armature is against action of said spring means.

4. The invention set forth in claim 3 wherein each of said ratchet wheels has four equally spaced teeth so that the resulting intermediate arrangement to said teeth between said wheels effectively places alternate teeth of each wheel at substantially 45°.

5. The invention set forth in claim 4 wherein said valve is rotated 45° during said initial movement and an additional 45° during said secondary continuing movement to complete 90° rotation of said valve from one set position to the other.

6. The invention set forth in claim 5 wherein said movement of said armature in one direction is where said solenoid is energized and movement of said armature in the other direction is when said solenoid is deenergized.

7. A refrigerator cabinet comprising:

a divider wall separating said cabinet into a freezer and fresh food compartment;

a refrigerator system including a condenser evaporator and compressor in closed series flow arrangement, said evaporator arranged in said freezer compartment;

an air circulating system including a fan in said freezer compartment for circulating air from both of said compartments through said evaporator;

a housing arranged on said divider including a passageway for directing a portion of said circulating air into said fresh food compartment;

a first temperature control means in said freezer compartment for causing energization of said compressor and said fan for maintaining said freezer compartment at a preselected temperature;

a valve member arranged in said housing for controlling the flow of air between compartment, said valve including axial members on the longitudinal ends thereof being arranged in said housings for allowing rotational movement of said valve in said passageway between set open and closed position;

indexing means arranged on one of said axial members having a drive end extending through said housing;

a first and second ratchet means mounted on said drive end, each having a like number of teeth being spaced circumferentially so that the teeth of one of said ratchets are positioned intermediate the other;

a solenoid mounted on said housing, including an armature arranged for perpendicular movement relates to said axial members;

actuating means on said armature, including a first pawl dimensioned to engage a tooth on said first ratchet for imparting initial rotational movement to said valve during movement of said armature in one direction when said solenoid is energized, and a second pawl dimensioned to engage a tooth on said second ratchet for imparting a secondary continuing rotational movement to said valve during the return movement of said armature in the other direction when said solenoid is deenergized to complete movement of said valve between its set positions;

means for locking said valve in each of its set positions when said armature is in its deenergized position, including stop means on said drive end having spaced teeth, holding means movable with said armature being dimensioned to engage one of said teeth on said stop means when said solenoid is in its deenergized position to stop said valve in its set positions;

a second temperature control means in said fresh food compartment for energizing said solenoid and said fan to control the flow of air through said passageway when the valve is in its fully open position.

8. The invention set forth in claim 7 wherein said solenoid is energized momentarily.

9. The invention set forth in claim 8 wherein said armature is maintained in its extended position by a spring means so that initial movement of said armature is against action of said spring means.

10. The invention set forth in claim 9 wherein each of said ratchet wheels has four equally spaced teeth so that the resulting intermediate arrangement to said teeth between said wheels effectively places alternate teeth of each wheel at substantially 45°.

11. The invention set forth in claim 10 wherein said valve is rotated 45° during said initial movement and an additional 45° during said secondary continuing movement to complete 90° rotation of said valve from one set position to the other.

12. The invention set forth in claim 11 wherein said movement of said armature in one direction is where said solenoid is energized and movement of said armature in the other direction is when said solenoid is deenergized.

13. An air valve for controlling the flow of air through a wall comprising:

a housing arranged on said wall including a passageway;

a valve member arranged in said housing for controlling the flow of air through said passageway, said valve including axial members on the longitudinal ends thereof being arranged in said housings for allowing rotational movement of said valve in said passageway between set open and closed position;

indexing means arranged on one of said axial members having a drive end extending through said housing;

a first and second ratchet means mounted on said drive end, each having a like number of teeth being spaced circumferentially so that the teeth of one of said ratchets are positioned intermediate the other;

a solenoid mounted on said housing, including an armature arranged for perpendicular movement relates to said axial members;

actuating means on said armature, including a first pawl dimensioned to engage a tooth on said first ratchet for imparting initial rotational movement to said valve during movement of said armature in one direction when said solenoid is energized, and a second pawl dimensioned to engage a tooth on said second ratchet for imparting a secondary continuing rotational movement to said valve during the return movement of said armature in the other direction when said solenoid is deenergized to complete movement of said valve between its set positions; and means for locking said valve in each of its set positions when said armature is in its deenergized position, including stop means on said drive end having spaced teeth, holding means movable with said armature being dimensioned to engage one of said teeth on said stop means when said solenoid is in its deenergized position to stop said valve in its set positions.

14. The invention set forth in claim 13 wherein said solenoid is energized momentarily.

15. The invention set forth in claim 14 wherein said armature is maintained in its extended position by a spring means so that initial movement of said armature is against action of said spring means.

16. The invention set forth in claim 15 wherein each of said ratchet wheels has four equally spaced teeth so that the resulting intermediate arrangement to said teeth between said wheels effectively places alternate teeth of each wheel at substantially 45°.

17. The invention set forth in claim 16 wherein said valve is rotated 45° during said initial movement and an additional 45° during said secondary continuing movement to complete 90° rotation of said valve from one set position to the other.

18. The invention set forth in claim 17 wherein said movement of said armature in one direction is where said solenoid is energized and movement of said armature in the other direction is when said solenoid is deenergized.

* * * * *